US010856596B1

(12) United States Patent
Banas

(10) Patent No.: US 10,856,596 B1
(45) Date of Patent: Dec. 8, 2020

(54) WAISTBAND EXPANDER

(71) Applicant: Sylwia Banas, Mt. Prospect, IL (US)

(72) Inventor: Sylwia Banas, Mt. Prospect, IL (US)

( * ) Notice: Subject to any disclaimer, the term of this patent is extended or adjusted under 35 U.S.C. 154(b) by 0 days.

(21) Appl. No.: 16/786,978

(22) Filed: Feb. 10, 2020

Related U.S. Application Data

(60) Provisional application No. 62/809,559, filed on Feb. 22, 2019.

(51) Int. Cl.
*A41F 9/02* (2006.01)

(52) U.S. Cl.
CPC ..... *A41F 9/02* (2013.01)

(58) Field of Classification Search
CPC ..... A41F 9/02; A41F 9/002; A41F 9/025
USPC ..... 2/237, 323
See application file for complete search history.

(56) References Cited

U.S. PATENT DOCUMENTS 261,664 A * 7/1882 Brown ..... A41F 9/025 2/309
592,001 A * 10/1897 Daum ..... A41F 9/002 2/301
983,449 A * 2/1911 Jones ..... A41F 9/025 2/309
1,488,587 A * 4/1924 Dochnal ..... A41F 19/00 2/309
1,998,865 A * 4/1935 Fekete ..... A41B 9/02 2/237
3,089,149 A 5/1963 Kelleam
3,431,562 A 3/1969 Sounders
4,580,298 A * 4/1986 Tuisl ..... A41F 9/025 2/220
4,920,581 A * 5/1990 Gray ..... A41F 9/02 2/221
5,163,184 A * 11/1992 Reardon ..... A41D 1/06 2/218
5,902,170 A 5/1999 Ganz
6,085,356 A 7/2000 Redmond, Sr.

OTHER PUBLICATIONS

"Maeband Maternity Belly Band | Pregnancy Belt, Waistband Extender, Pregnancy Clothes, Maternity Jeans" as downloaded from the Internet website "https://www.amazon.com/Maeband-Maternity-Pregnancy-Waistband-Extender/dp/B01N9417XA" on Dec. 23, 2019.

* cited by examiner

*Primary Examiner* — Timothy K Trieu
(74) *Attorney, Agent, or Firm* — Quickpatents, LLC; Kevin Prince

(57) ABSTRACT

An expander for a waistband of a lower garment having a fly has a first section and a second section fixed with opposing ends of an elastic strap. With a button hole of the first section fixed with a button of the fly, and with a button of the second section fixed with a button hole of the fly, the waistband of the lower garment is expanded. A center section of the elastic strap may include a zipper pull fixing implement fixed with a zipper pull of a zipper of the fly to inhibit the zipper pull from dropping. An elongated cover strap may be fixed to the first section and include an attachment mechanism that allows the cover strap to be looped through one or more belt loops of the lower garment and folded over itself to cover the first section, center section, and second section.

13 Claims, 6 Drawing Sheets

WAISTBAND EXPANDER

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

CROSS-REFERENCE TO RELATED APPLICATIONS

This application claims the benefit of U.S. Provisional Patent Application 62/809,559, filed on Feb. 22, 2019, and incorporated herein by reference.

STATEMENT REGARDING FEDERALLY SPONSORED RESEARCH AND DEVELOPMENT

Not Applicable.

FIELD OF THE INVENTION

This invention relates to garments, and more particularly to a waistband expander for a waistband of pants, shorts, or the like.

BACKGROUND

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The shape of a woman's body changes dramatically during pregnancy, and even after pregnancy, can require considerable time and effort to return to normal. In particular, the pregnant woman's belly goes through several phases, expanding and retracting over a period of time which is relatively short in comparison to non-pregnancy related weight gains and losses.

At some point during pregnancy and for a given period post-partum, the pregnant woman is typically unable to wear her normal clothes, particularly pants and skirts, which can no longer be fastened at the fly. Specialized maternity clothes are available but even with these specialized items, the continued changes in the shape of the pregnant woman often result in constant challenges with any clothing. While the maternity apparel industry has responded to the extent it can by developing new designs intended to expand and retract with the pregnant and post-pregnancy changes, the results are often unsatisfactory and stylistically unpleasing. Despite the efforts of maternity apparel companies, the range of sizes of at which women begin and end their pregnancies is so vast that creating garments that can last throughout pregnancy is simply too challenging.

Pregnancy isn't the only condition during which waists may expand. Many people experience some fluctuation in their weight over time. People often become more sedentary during the winter months, when they're less likely to be outside engaging in calorie-burning activities. The fall and winter also bring holidays, with their traditional big meals and calorie-laden treats. "Packing on a few pounds" during the holidays can transform otherwise comfortable garments into tight-waisted, binding, uncomfortable, constrictors. Additionally, people become bloated for a variety of reasons, rendering their waistbands constrictive and uncomfortable. Furthermore, because not everyone can afford custom-tailored clothes, garments such as pants or skirts that feature waistbands may fit a person in the waist, but not in the hips, or vice versa.

In the prior art, these problems have been addressed in various ways. U.S. Pat. No. 4,580,298 to Tuisl on Apr. 8, 1986 shows a waistband extender allowing the pants to be worn open, but with an elastic strip connecting to the waistband at the top so as to allow an expanded size at the waist; U.S. Pat. No. 6,085,356 to Redmond, Sr. on Jul. 11, 2000 is similar. U.S. Pat. No. 2,787,792 shows a maternity skirt with an elastic insert in the area needing additional room; U.S. Pat. No. 4,280,229 is somewhat similar. U.S. Pat. No. 5,902,170 to Ganz on May 11, 1999 merely shows a band worn as an undergarment, to give the body a more pleasing shape. U.S. Pat. No. 3,431,562 to Sounders on Mar. 11, 1969, and U.S. Pat. No. 3,089,149 to Kelleam on May 14, 1963 show skirts that can be re-shaped with insert panels to provide for a larger waist.

None of the prior art methods have been found to be completely suitable to meet these needs and are cumbersome. Therefore, there is a need for a device that allows the pregnant woman's normal clothes to be worn, throughout much of the pregnancy and postpartum, in a comfortable and attractive manner. Such a needed invention would be relatively inexpensive to manufacture, machine washable, and intuitive to use. The present invention accomplishes these objectives.

SUMMARY OF THE INVENTION

The present device is an expander for a waistband of a lower garment, such as a pair of pants. The lower garment is of the type having a fly with a button side that has a button, and a button hole side that has a button hole. Typically the fly is closed with a zipper having a zipper pull.

The expander includes an elastic strap that has a first end and a second end. A first section is fixed with the first end of the elastic strap and includes at least one button hole traversing from a front side thereof to a back side thereof. A second section is fixed with the second end of the elastic strap and includes at least one button fixed with a front side thereof.

In use, with the at least one button hole of the first section fixed with the button of the button side of the fly, and with the at least one button of the second section fixed with the button hole of the button hole side of the fly, the waistband of the lower garment is expanded.

Preferably the elastic strap further includes a center section that has a front side, a back side, and a zipper pull fixing implement, such that the zipper pull of the zipper of the lower garment may be fixed with the zipper pull fixing implement to inhibit the zipper pull from lowering or dropping.

Such a zipper pull fixing implement may include a connector having two opposing ends, each of which terminate in a hook that is adapted for securing to the center section of the elastic strap or to the zipper pull, for example. Alternately, the zipper pull fixing implement make take the form of a fabric, metallic, or plastic loop through which one of the hooks of the connector can traverse.

Alternately, the connector may include a button stud having an elastic band fixable to the zipper pull, the button stud traversing the zipper pull fixing implement which, in this type of embodiment, takes the form of at least one button hole or aperture.

In a second embodiment of the invention, an elongated cover strap having a front side, a back side, a distal end, and a proximal end is fixed at the proximal end thereof to the first section. The elongated cover strap includes an attachment mechanism for allowing the cover strap to be looped through one or more belt loops of the lower garment and folded over itself to cover the first section, center section, and second section.

Preferably the attachment mechanism includes a hook-and-loop type fastener material that has a hook side included on the front side of the distal end of the elongated cover strap, and a loop side included on the front side of the elongated cover strap and/or the front side of the center section.

The present invention is a device that allows the pregnant woman's normal clothes to be worn, throughout much of the pregnancy and postpartum, in a comfortable and attractive manner. The present device works by allowing the length of the waistband of the pregnant woman's pants to be expanded, allows closure of the waistband through the use of the existing button and button hole, and provides for the zipper to be maintained in a raised or semi-raised position. The present device is relatively inexpensive to manufacture, machine washable, and intuitive to use. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
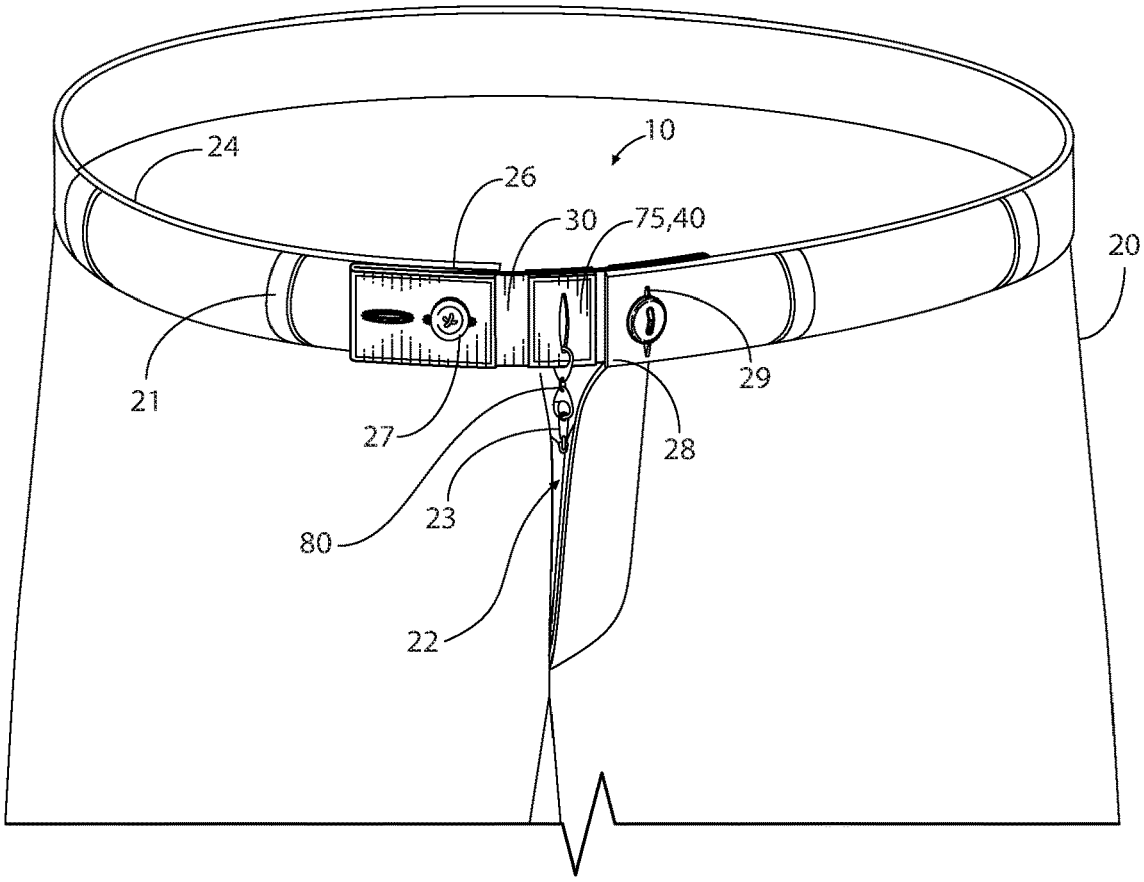
FIG. 1 is a front perspective view of a first embodiment of the invention.
Figure 2:
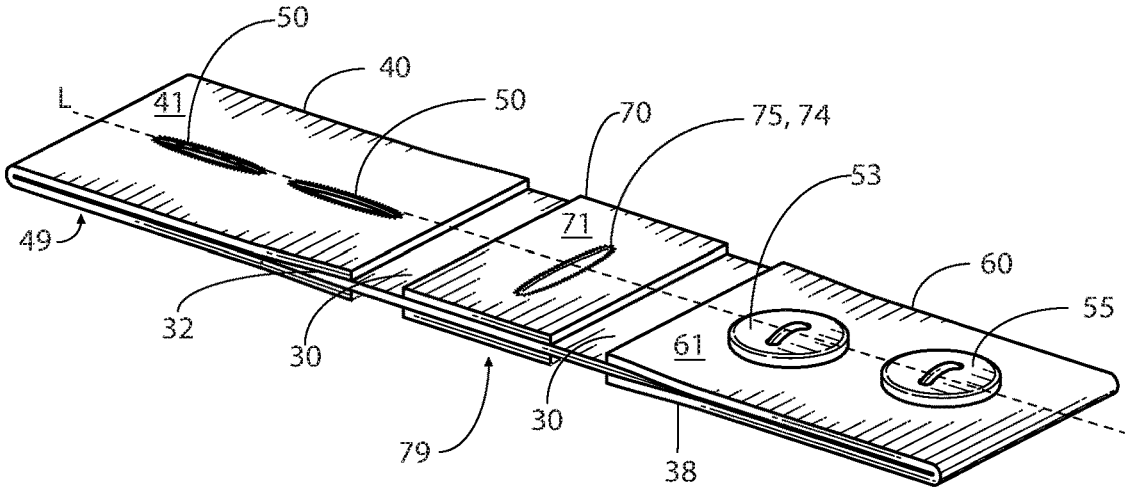
FIG. 2 is an enlarged perspective view of the embodiment of FIG. 1.
Figure 3:
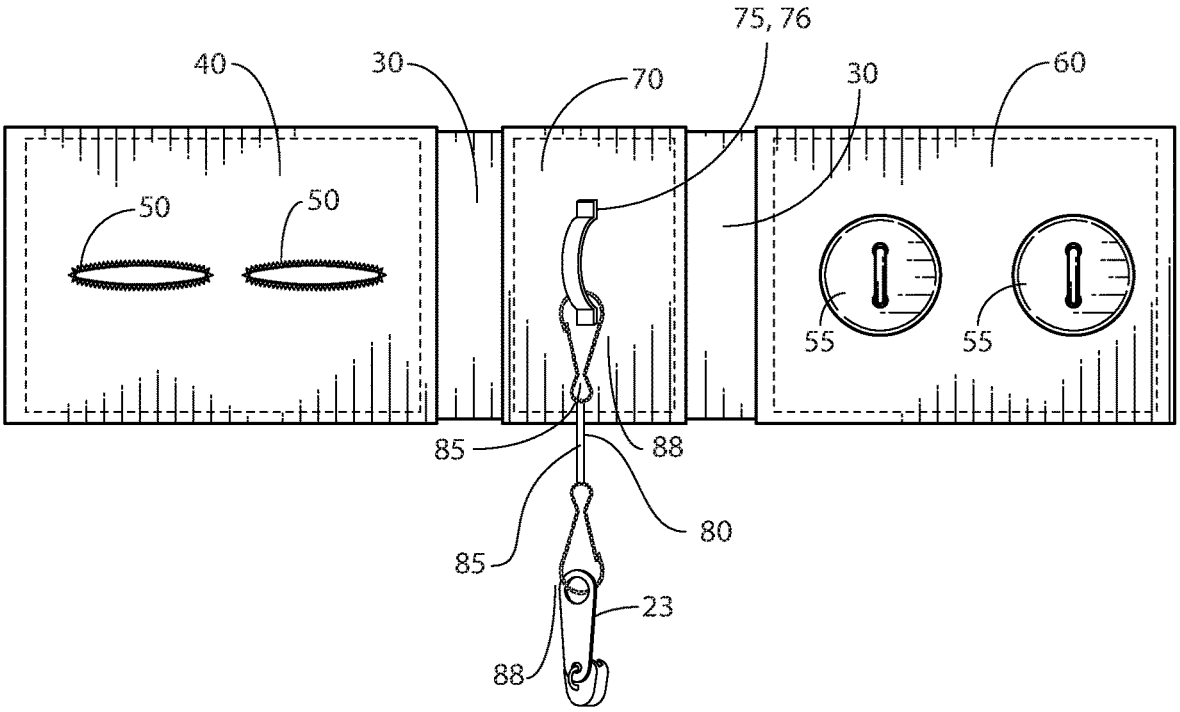
FIG. 3 is a front elevational view of the embodiment of FIG. 1.

FIGS. 1-3 illustrate an expander 10 for a waistband 24 of a lower garment 20, such as a pair of pants. The lower garment 20 is of the type having a fly 25 with a button side 26 that has a garment button 27, and a button hole side 28 that has a garment button hole 29. Typically the fly 25 is closed with a zipper 22 having a zipper pull 23.

The expander 10 includes an elastic strap 30 that has a first end 32 and a second end 38. The elastic strap 30 is made from an elastic material such as spandex, latex, neoprene or the like.

A first section 40 is fixed with the first end 32 of the elastic strap 30 and includes at least one button hole 50 traversing from a front side 41 thereof to a back side 49 thereof. The first section 40 is preferably made from a material that is less elastic than the elastic strap 30, such as a textile or fabric web, such as nylon for example.

A second section 60 is fixed with the second end 38 of the elastic strap 30 and includes at least one button 55 fixed with a front side 61 thereof. The second section 60 is preferably made from a material that is less elastic than the elastic strap 30, such as a textile or fabric web, such as nylon for example, and is preferably the same material that the first section 40 is made with.

In preferred embodiments the first section 40 includes exactly two of the button holes 50 and the second section 60 includes exactly two of the buttons 55.

In use, with the at least one button hole 50 of the first section 40 fixed with the garment button 27 of the button side 26 of the fly 25, and with the at least one button 55 of the second section 60 fixed with the garment button hole 29 of the button hole side 28 of the fly 25, the waistband 24 of the lower garment 20 is expanded.

Preferably the elastic strap 30 further includes a center section 70 that has a front side, 71, a back side 79, and a zipper pull fixing implement 75, such that the zipper pull 23 of the zipper 22 of the lower garment 20 may be fixed with the zipper pull fixing implement 75 to inhibit the zipper pull 23 from lowering or dropping. The center section 70 is preferably made from a material that is less elastic than the elastic strap 30, such as a textile or fabric web, such as nylon for example, and is preferably the same material that the first section 40 and the second section 60 are made with.

Such a zipper pull fixing implement 75 may include a connector 80 having two opposing ends 85, each of which terminate in a hook 88 that is adapted for securing to the center section 70 of the elastic strap 30 or to the zipper pull 23, for example. Alternately, the zipper pull fixing implement 75 make take the form of a fabric, metallic, or plastic loop 76 through which one of the hooks 88 of the connector 80 can traverse.

Figure 7:
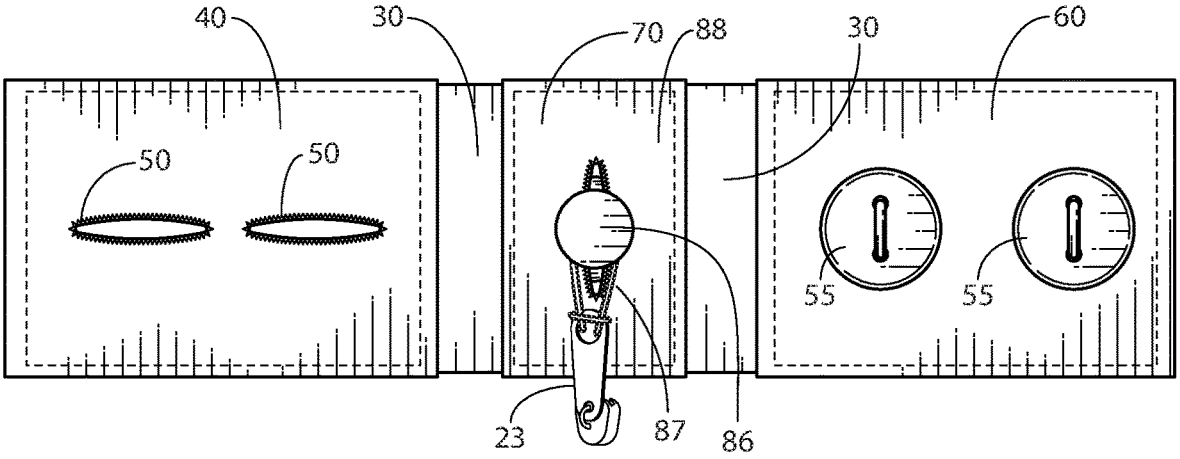
FIG. 7 is an alternate attachment mechanism between a center section of the invention and a zipper pull of the pair of pants.

Alternately, the connector 80 may include a button stud 86 having an elastic band 87 fixable to the zipper pull 23, the button stud 86 (FIG. 7) traversing the zipper pull fixing implement 75 which, in this type of embodiment, takes the form of at least one button hole or aperture 74. Preferably such an aperture 74 is orthogonal to a longitudinal axis L of the elastic strap 30 (FIG. 2).

Figure 4:
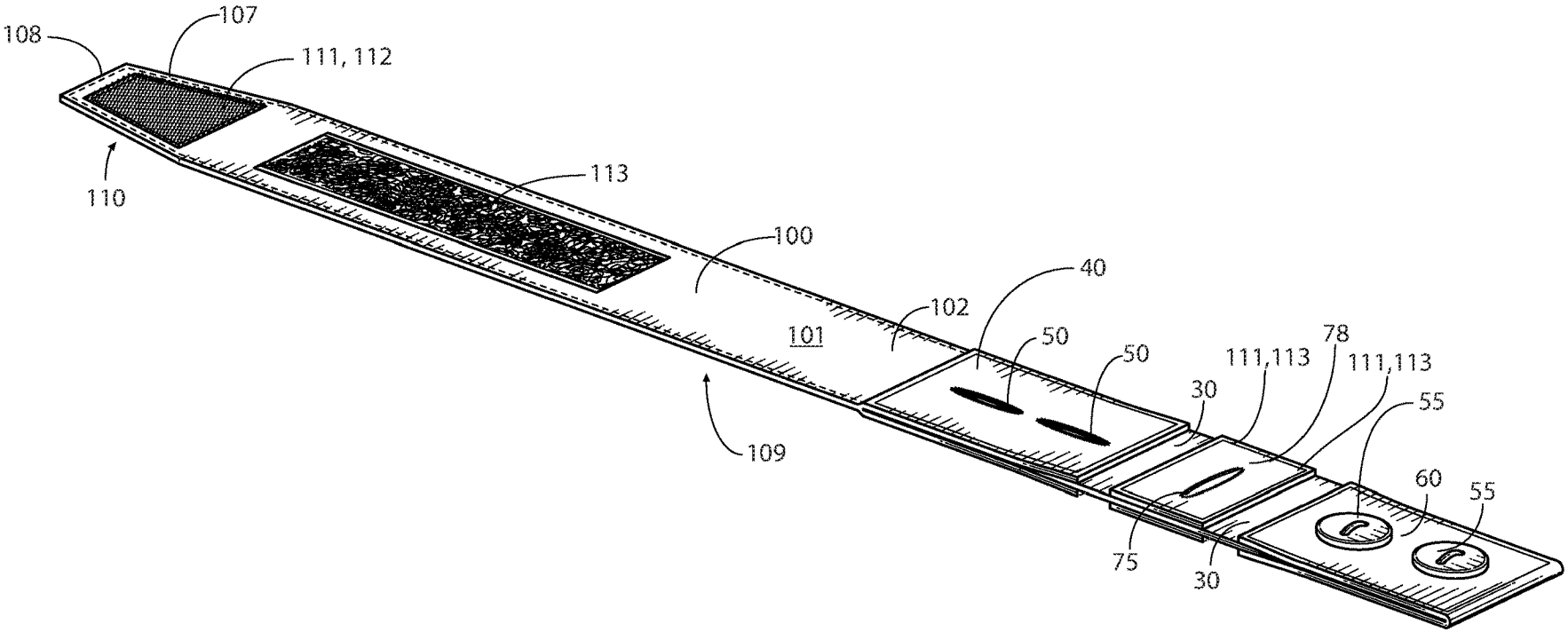
FIG. 4 is a perspective view of a second embodiment of the invention.
Figure 5:
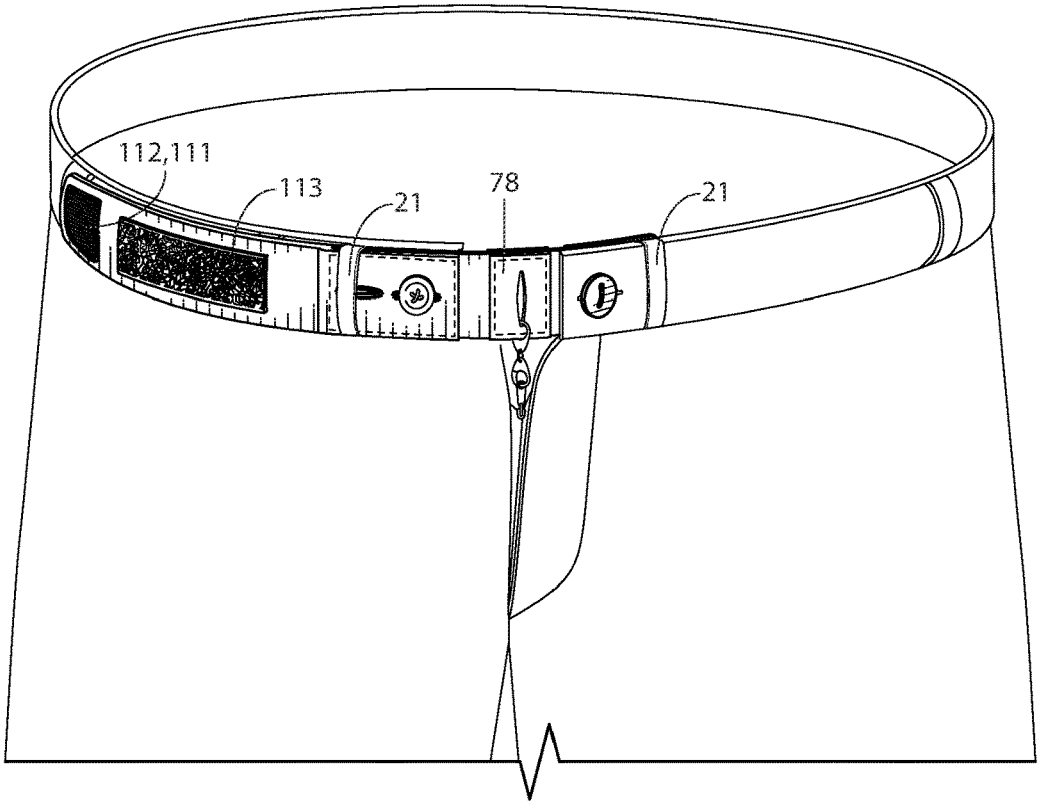
FIG. 5 is a front perspective view of the embodiment of FIG. 4, illustrated in an in-use condition with a pair of pants, a cover flap extended away from a fly of the pair of pants.
Figure 6:
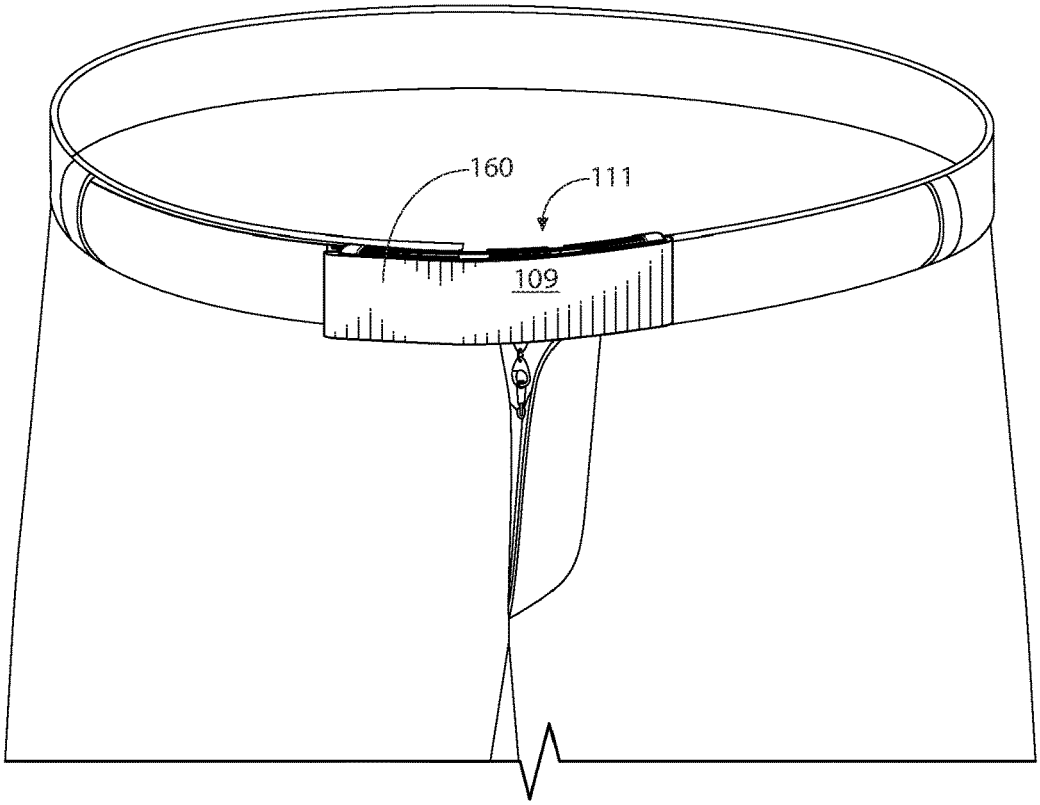
FIG. 6 is a front perspective view of FIG. 5 but with the cover flap folded over to cover a front portion of the pair of pants.

In a second embodiment of the invention, an elongated cover strap 100 (FIG. 4-6) having a front side 101, a back side 109, a distal end 108, and a proximal end 102 is fixed at the proximal end 102 thereof to the first section 40. The elongated cover strap 100 includes an attachment mechanism 110 for allowing the cover strap 100 to be looped through one or more belt loops 21 of the lower garment 20 and folded over itself to cover the first section 40, center section 70, and second section 60 (FIG. 6). Preferably the distal end 108 of the elongated cover strap 100 includes a tapered end 107 to facilitate threading of the elongated cover strap 100 through the one or more belt loops 21 of the lower garment 200.

Preferably the attachment mechanism 110 includes a hook-and-loop type fastener material 111 that has a hook side 112, included on the front side 101 of the distal end 108 of the elongated cover strap 100, and a loop side 113 included on the front side of the elongated cover strap 100 and/or the front side 71 of the center section 70. In one embodiment, the attachment mechanism 110 may include one of the button holes 50 (FIG. 4) proximate the distal end 108 of the elongated cover strap 100, such a button hole 50 suitable for fastening with the garment button 27 of the lower garment 20.

Figure 8:
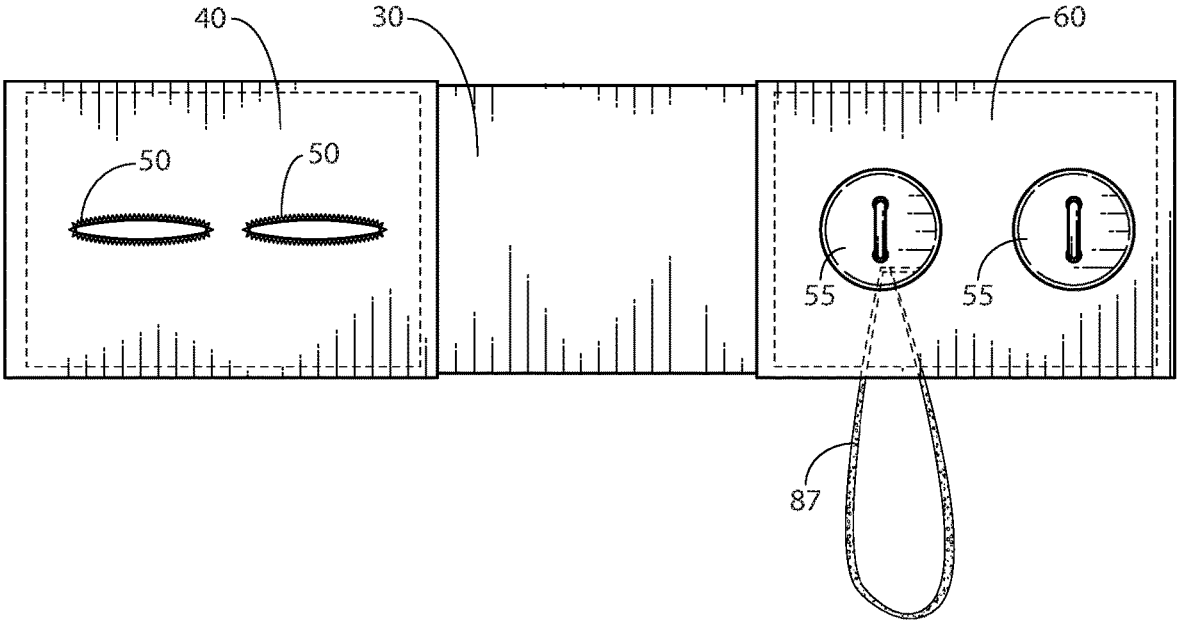
FIG. 8 is a front elevational view of another alternate embodiment of the invention with the center section omitted.
Figure 9:
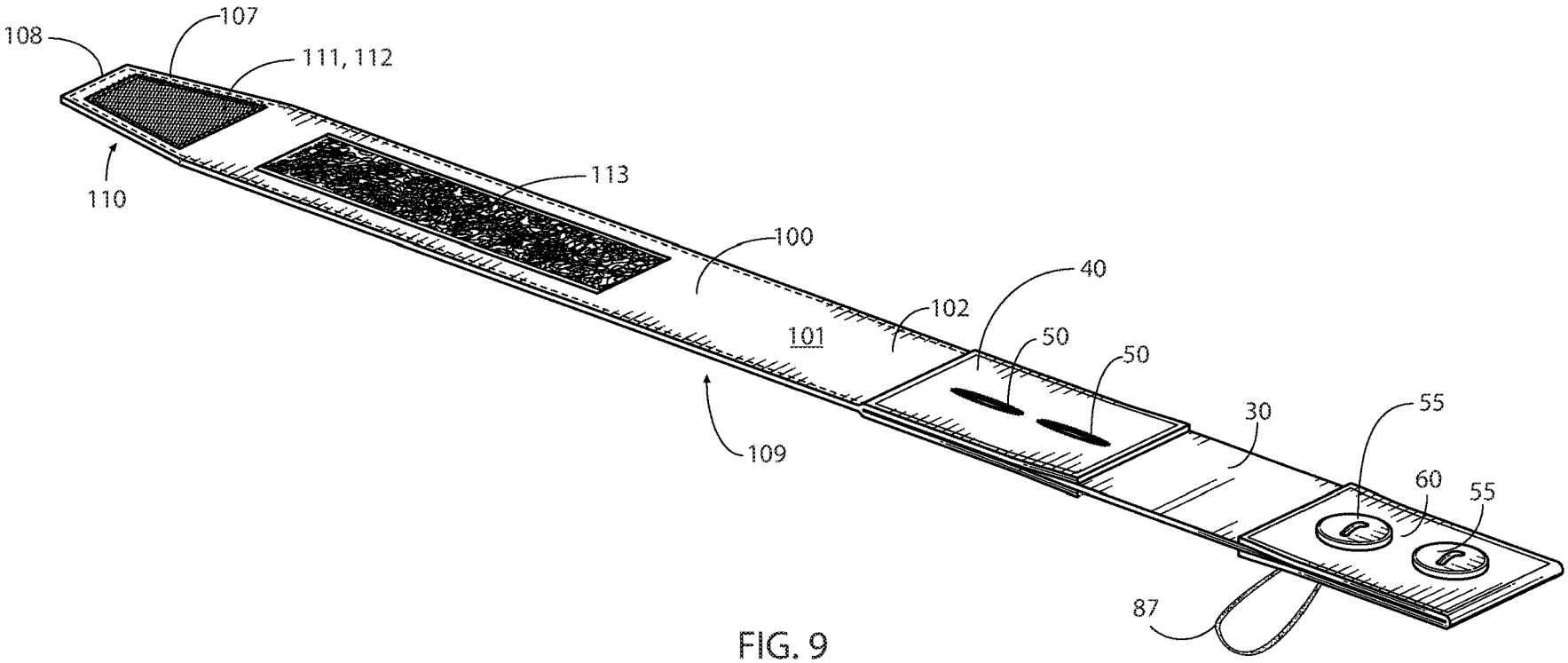
FIG. 9 is a perspective view of yet another alternate embodiment of the invention, also with the center section omitted.

In some embodiments of the invention, the center section 70 is omitted (FIGS. 8 and 9). Such embodiments work well with patents 20 that have a zipper of the type that locks in place when the zipper pull is placed in a downward position, for example, and the zipper pull does not have to be maintained in a raised position. Alternately with such embodiments the elastic band 87 may be fixed to a rear side 69 of the second section (FIGS. 8 and 9), the elastic band 87 fixable to the zipper pull 23 to maintaining the zipper pull 23 in a raised position. In such an embodiment the elastic band 87 is threaded through the zipper pull 23 and then secured around the button 55 to maintain the zipper pull 23 in the raised position.

While a particular form of the invention has been illustrated and described, it will be apparent that various modifications can be made without departing from the spirit and scope of the invention. For example, the shape or style of the waist expander 10 may be varied from that shown in the figures. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An expander for a waistband of a lower garment of the type having a fly with a button side having a garment button and a button hole side having a garment button hole, the expander comprising:

an elastic strap having a first end and a second end;

a first section fixed with the first end of the elastic strap, the first section including at least one button hole traversing from a front side thereof to a back side thereof;

a second section fixed with the second end of the elastic strap, the second section including at least one button fixed with a front side thereof;

a center section having a front side, a back side, and a zipper pull fixing implement;

wherein the zipper pull fixing implement including a connector having two opposing ends, each of the opposing ends terminating in a hook adapted for securing the center section of the elastic strap to a zipper pull of a zipper of the lower garment;

whereby with the at least one button hole of the first section for fixing with the garment button of the button side of the fly, and with the at least one button of the second section for fixing with the garment button hole of the button hole side of the fly, the waistband of the lower garment is expanded by the expander, and whereby the zipper full fixing implement is configured to fix to the zipper pull of a zipper of the lower garment to inhibit the zipper pull from dropping.

2. The expander of claim 1 wherein the first section includes exactly two of the button holes, and wherein the second section includes exactly two of the buttons, the button holes of the first section and the buttons of the second section each longitudinally aligned with the elastic strap.

3. The expander of claim 1 wherein the zipper pull fixing implement includes at least one aperture traversing through the center section from the front side to the back side of the expander.

4. The expander of claim 1 wherein the zipper pull fixing implement includes a loop through which one of the hooks of the connector can traverse.

5. The expander of claim 4 wherein the loop is a fabric loop.

6. The expander of claim 4 wherein the loop is a metallic loop.

7. The expander of claim 1 further including an elongated cover strap having a front side, a back side, a distal end, and a proximal end fixed with the first section, the elongated cover strap including an attachment mechanism for allowing the cover strap to be looped through a belt loop of the garment and folded over itself to cover the first section, center section, and second section.

8. The expander of claim 7 wherein the attachment mechanism includes a hook-and-loop type fastener material.

9. The expander of claim 8 wherein a hook side of the hook-and-loop type fastener material is included on the front side of the distal end of the elongated cover strap, and wherein a loop side of the hook-and-loop type fastener material is included on the front side of the center section and/or the front side of the second section.

10. The expander of claim 7 wherein the wherein the distal end of the cover strap is tapered to facilitate threading of the cover strap through the belt loop of the garment.

11. The expander of claim 7 wherein the attachment mechanism of the elongated cover strap includes a button hole proximate the distal end of the elongated cover strap.

12. The expander of claim 1 wherein the first section and the second section both have less elasticity than the elastic strap.

13. The expander of claim 1 wherein the first section, the center section, and the second section are all have less elasticity than the elastic strap.

* * * * *